United States Patent [19]

Ihara et al.

[11] Patent Number: 5,042,729

[45] Date of Patent: Aug. 27, 1991

[54] PULVERIZING APPARATUS

[75] Inventors: Yoshitaka Ihara; Akira Ganse; Haruhiko Oyanagi; Iwao Ikebuchi, all of Osaka, Japan

[73] Assignee: Kubota, Ltd., Osaka, Japan

[21] Appl. No.: 465,170

[22] PCT Filed: Jun. 27, 1989

[86] PCT No.: PCT/JP89/00638

§ 371 Date: Feb. 27, 1990

§ 102(e) Date: Feb. 27, 1990

[87] PCT Pub. No.: WO90/00444

PCT Pub. Date: Jan. 25, 1990

[30] Foreign Application Priority Data

Jul. 9, 1988 [JP] Japan ..... 63-171134

[51] Int. Cl.[5] ..... B02C 17/16

[52] U.S. Cl. ..... 241/171; 241/172

[58] Field of Search ..... 241/171, 172, 46.17, 241/46.11

[56] References Cited

U.S. PATENT DOCUMENTS

| | | | |
|---|---|---|---|
| 2,592,994 | 4/1952 | Ahlmann | 241/172 X |
| 3,423,032 | 1/1969 | Eckert | 241/172 X |
| 3,672,580 | 6/1972 | Nye | 241/172 X |
| 3,802,633 | 4/1974 | Schold | 241/172 X |
| 4,850,541 | 7/1989 | Hagy | 241/171 |

FOREIGN PATENT DOCUMENTS

| | | |
|---|---|---|
| 5584 | 4/1964 | Japan . |
| 12933 | 6/1966 | Japan . |
| 33639 | 2/1986 | Japan . |

*Primary Examiner*—Mark Rosenbaum

*Attorney, Agent, or Firm*—Wenderoth, Lind & Ponack

[57] ABSTRACT

This invention relates to an apparatus for pulverizing quick lime into a slurry form. It has a vertical shell and a rotary shaft mounted in the shell. An agitating layer and a pulverizing layer are formed in the shell at its upper and lower portions, respectively. The material fed from top of the shell is agitated and melted into smaller particles in the agitating layer and then pulverized into fine particles in the pulverizing layer. The fine particles are discharged from a top or middle of the shell. A discharge pipe is provided so as to extend upwardly from the discharge port at the middle of the shell. An agitator may be provided in the discharge pipe. The material to be pulverized is prevented from going from the inlet directly to the outlet without passing through the pulverizing layer.

3 Claims, 2 Drawing Sheets

PULVERIZING APPARATUS

TECHNICAL FIELD

The present invention relates to a pulverizing apparatus for pulverizing a material into a slurry form.

BACKGROUND ART

As a method of desulfurizing exhaust gas, it is known to spray thereon slaked lime in the form of slurry. A conventional apparatus for producing such slaked lime is shown in FIG. 5. This apparatus comprises a vertical shell 1 filled with a pulverizing medium b and a screw shaft 2 extending vertically in the shell 1. A quick lime material s and water are fed into the shell from its top. The material s is pulverized by the friction with the pulverizing medium b and between its own particles while reacting with water such that it turns into slaked lime in the form of slurry.

Since solid impurities such as calcium carbonate and gravel contained in the material are also pulverized into fine particles, the material turns into slaked lime c in the form of slurry containing the above fine particles of impurities and continuously flows out through an outlet 3 at the upper part of the shell 1 into a settling separator 4. It is necessary to pulverize the impurities into fine particles in order to prevent a nozzle from clogging during the above-described spraying. In the drawing, letter P indicates a circulating pump for the settled product.

But during the above-described pulverizing operation, any quick lime material s which is too large to be mixed into a layer of the pulverizing medium b tends to flow directly to the outlet 3 from the inlet. Such unpulverized large-diameter particles are liable to flow through the settling separator 4 and mix into the end product d, thus lowering its commercial value. The larger the ratio of the quick lime material to water, the more remarkable this phenomenon will be. This is because the viscosity of the slurry increases and the separation efficiency by settling decreases as the concentration of the material s grows. Thus, such a conventional apparatus has to be operated under low-concentration conditions. This will lower the production efficiency.

Meanwhile, it is known that a soluble material such as soil stuck to solid pieces such as stones serves to bind them together. If the soluble material melts, the solid pieces will separate. As to the quick lime material s, it contains impurities having a soluble material such as quick lime and the like stuck thereto. If the quick lime and the like melts as a result of reaction, the diameter of its particles will decrease. In other words, the particle diameter of the quick lime material can be reduced and thus it can easily mix into the layer of pulverizing medium b by promoting its reaction and melting.

An object of the present invention is to enhance the reaction and melting of quick lime and to smoothly mix the material to be pulverized into the pulverizing layer by agitating the material in a vertical shell.

SUMMARY OF THE INVENTION

In accordance with the present invention, there is provided a pulverizing apparatus comprising a vertical shell for containing a liquid such as water and a pulverizing medium, and a rotary shaft rotatably mounted in said vertical shell and having a plurality of agitating vanes mounted in an upper portion thereof to form an agitating layer and having a screw in an lower portion thereof to form a pulverizing layer with the pulverizing medium.

The agitating vane should preferably be shaped to produce a downward current of the material.

The apparatus according to the present invention has a material inlet disposed at a top of the vertical shell and a product outlet disposed at the top or middle of the vertical shell. A discharge pipe may be provided so as to extend upwardly from the outlet. The discharge pipe may be provided with a gate for determining the water level in the vertical shell. Also, an agitator should be provided in the discharge pipe.

The material to be pulverized may be any material which reacts with water or other liquid and melts into a slurry form, such as quick lime and dolomite.

With the pulverizer having a construction as described above, when the material to be pulverized is fed into the shell from its upper part with the rotary shaft in rotation, it will be agitated and melted while settling down in the agitating layer. By arranging the agitating blades so as to form a downward current, the material to be pulverized will reliably mix into the agitating layer and will be agitated. By promoting the melting, the material can turn rapidly into slurry and its particle diameter can be reduced, because the material acting as a binder melts. If for example the material to be pulverized is quick lime, not only will the above-mentioned action be promoted, but reaction of the quick lime will also be promoted. Thus the material can be turned into slurry more rapidly and the particle diameter can be reduced still further.

As described above, the particle size of the material to be pulverized is reduced while it settles down in the agitating layer. The particles which have been pulverized into a sufficiently small size will be entrained in a current toward the outlet, whereas the particles too coarse to be entrained in this current will be mixed in the pulverizing layer and pulverized into fine particles.

This operation is carried out in the agitating layer and the pulverizing layer in a continuous and complex manner so that the material to be pulverized can leave the shell in a slurry form.

If the inlet port is formed in the upper part of the vertical shell, the outlet discharge port is formed in the middle level of the shell, a discharge pipe is provided so as to extend upwardly from the outlet port, and the discharge pipe is formed with a gate for determining the liquid level in the vertical shell, such that the material to be pulverized will flow through the agitating layer without failure. Thus, the agitating efficiency is improved.

Further, by the provision of an agitator in the discharge pipe, the latter will be prevented from getting clogged with the material to be pulverized.

DETAILED DESCRIPTION OF

Embodiment 1

Figure 1:
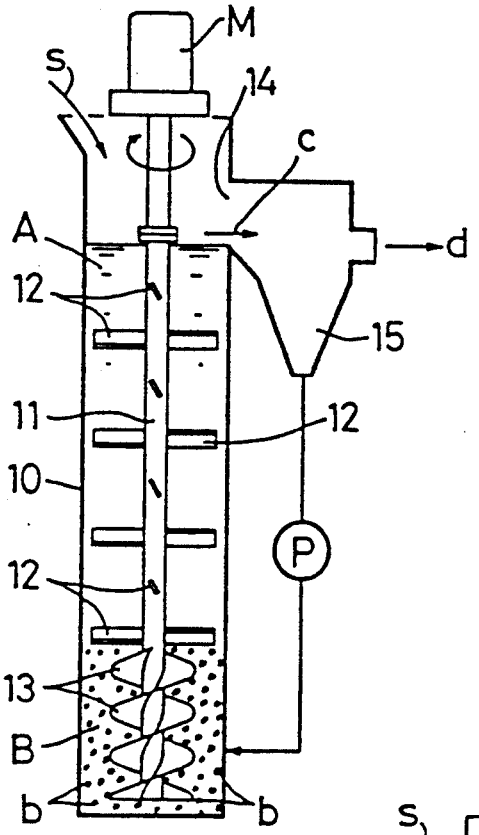
FIGS. 1 to 4 are schematic views of four embodiments of the pulverizing apparatus according to the present invention.

As shown in FIG. 1, a rotary shaft 11 is provided along the central axis of a vertical cylindrical shell 10. The rotary shaft 11 is provided at its upper part with radially extending agitating vanes 12 arranged at axially equal intervals. An agitating layer (or slaking layer) A is formed in the shell 10 at its upper portion. The agitating vanes 12 are inclined forwardly with respect to the direction of rotation so that they will form a downward current while in rotation. The angle of inclination of the agitating vanes 12 may be determined suitably according to the application. They may be arranged so that their width will extend in the axial direction of the rotary shaft 11, instead of being inclined.

Also, the rotary shaft 11 is provided at its lower portion with a screw 13 and a pulverizing layer B filled with pulverizing medium b is formed in the shell at its lower portion. Accordingly, when the quick lime material s is fed into the reach of the agitating vanes 12 from the upper part of the shell 10 together with water, it will be agitated and will react with the water in the agitating layer A. Thus, the slaked lime melts and turns into slurry and the material s is pulverized. In the material, the particles which have been pulverized to a sufficiently small size are entrained in a current toward an outlet port 14 which is to be described later, whereas the remaining portion of the material s (the lime left unreacted and the impurities) will settle down into the pulverizing layer B where it will be pulverized into fine particles by the friction with the pulverizing medium b and the friction between its own particles. The particles thus pulverized will rise in the shell with the upward current.

The shell 10 has an outlet (discharge) port 14 formed at a side thereof opposite the inlet port for the quick lime material. The slurry of slaked lime c containing the particles carried on the upward current will flow through the outlet port 14 into a settling separator 15, in which the mixed coarser particles mixed (the unreacted lime and impurities) will settle, whereas the remainder will overflow the separator so as to be taken out as the end product d. The coarser particles which have settled are carried back to the shell 10 by a pump P.

The volume ratio between the agitating layer A and the pulverizing layer B should be determined suitably through experiments. In the drawings, letter M indicates a driving means.

Embodiment 2

Figure 2:
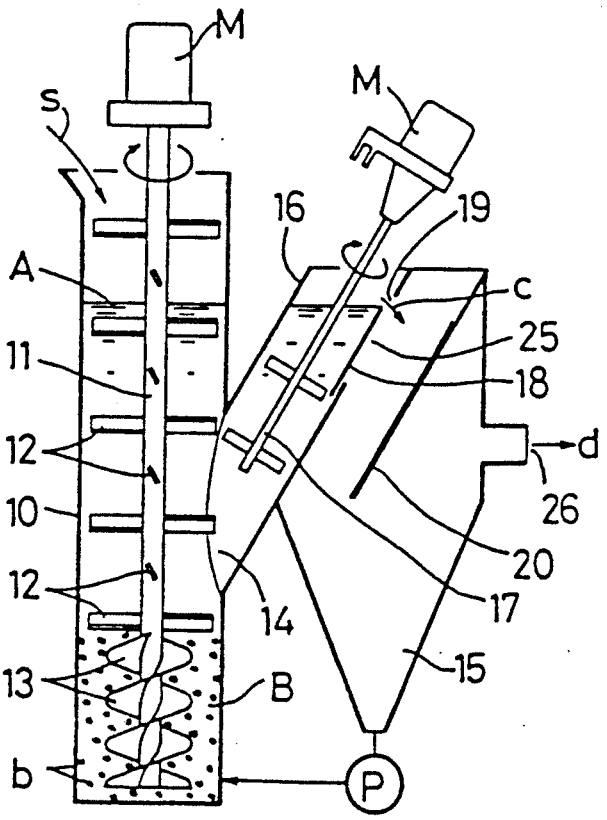

In the embodiment shown in FIG. 2, the outlet port 14 is formed in the shell 10 at the middle level thereof. A discharge pipe 16 is provided to extend obliquely upwardly from the outlet port 14. In the discharge pipe 16, there is provided an agitator 17 to prevent the pipe 16 from getting clogged with a slurry of slaked lime c. This is especially effective for pulverization under high-concentration conditions. The outlet port 14 may be covered with a screen to prevent the pulverizing medium b from flowing out.

The discharge pipe 16 is formed in its upper part at the side thereof facing the settling separator 15 with an opening 25. This opening is closed with an adjustable plate 18 which is axially movably mounted so as to be fixed at a desired position. The top edge of this adjustable plate 18 serves as a gate 19. By moving the adjustable plate 18, the level of the gate 19 and thus the liquid level in the shell 10 are determined. The adjustable plate 18 may be fixed in position by bolts or the like. In the settling separator 15, there is provided a plate 20 extending downwardly beyond the level of its outlet port 26 to prevent the slurry from going directly to the outlet 26. The slaked lime will thus remain in the settling separator for a longer period of time. This anti-shortcircuitting plate 20 has an adjustable position.

In this embodiment, the material s to be pulverized (quick lime material) is sure to pass through the agitating layer A. This promotes the reaction and melting of the material. Also, the downward current formed in the agitating layer A allows the material to settle down smoothly and allows the coarser particles to mix smoothly into the pulverizing layer B.

Embodiment 3

Figure 3:
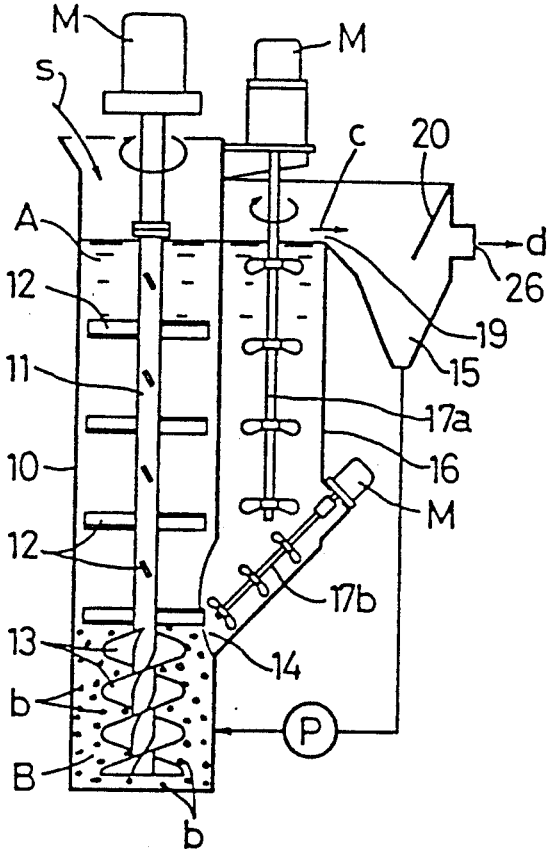

In the embodiment shown in FIG. 3, the single agitator 17 used in the embodiment 2 is replaced with two agitators 17*a* and 17*b*. The smaller agitator 17*b* is provided near the outlet port 14 to agitate the material near the outlet port where clogging is most likely to take place. The number of agitators 17 is not limited to two. They may be provided in any appropriate number.

Embodiment 4

Figure 4:
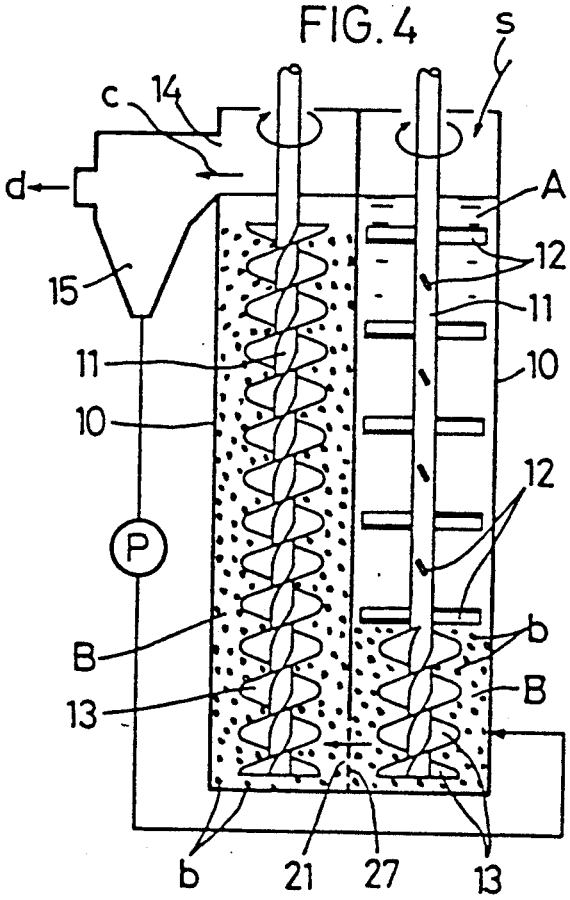
Figure 5:
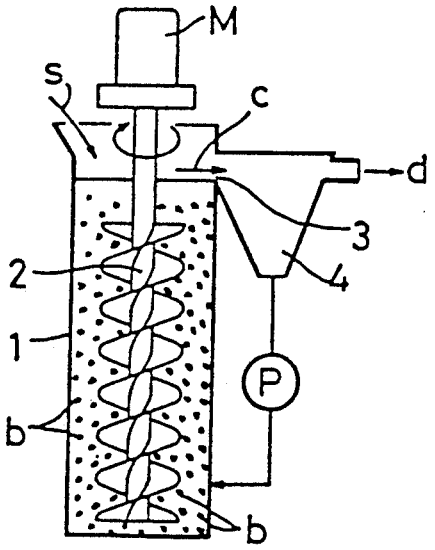
FIG. 5 is a schematic view of an example of a prior art apparatus.

In the embodiment shown in FIG. 4, there are provided two vertical shells 10, one having the agitating layer A and the pulverizing layer B and the other having only the pulverizing layer B. With this arrangement, the pulverizing time can be extended. A communicating hole 21 formed between the shells 10 is covered with a screen 27 to prevent the pulverizing media b in the respective shells 10 from passing through the hole 21 and mixing together. Three or more shells 10 may be used.

Industrial Application

The apparatus according to the present invention can produce slaked lime in a slurry form with good efficiency and the slaked lime obtained can be used for the desulfurization of exhaust gas. It can also be melted in water or other liquid for the production of other material.

What are claimed are:

1. A pulverizing apparatus comprising a vertical shell for containing material including a liquid and a pulverizing medium, said shell having a top inlet, and a rotary shaft having a plurality of agitating vanes mounted at an upper portion thereof to form an agitating layer and having a screw at a lower portion thereof to form a pulverizing layer;

wherein said agitating vanes are shaped to produce a downward current of the material; and wherein the material to be pulverized is fed into said shell through said top inlet, a discharge port being formed at a middle portion of said shell, and a discharge pipe being provided so as to extend upwardly from said discharge port.

2. A pulverizing apparatus as recited in claim 1, wherein said discharge pipe is provided with a gate for adjusting the liquid level in said vertical shell.

3. A pulverizing apparatus as recited in claim 1, wherein an agitator is mounted in said discharge pipe.

* * * * *